US011236974B2

(12) United States Patent
Novo Mercado

(10) Patent No.: US 11,236,974 B2
(45) Date of Patent: Feb. 1, 2022

(54) ANTI-STATIC, FOLDING CONTAINER FOR BLASTING OPERATIONS, WHICH CAN BE PARTIALLY COMPRESSED, AND ASSOCIATED ACCESSORIES

(71) Applicant: FABRISER, S.A. DE C.V., Tlaquepaque (MX)

(72) Inventor: Pedro Augusto Novo Mercado, Tlaquepaque (MX)

(73) Assignee: FABRISER, S.A. DE C.V., Jalisco (MX)

( * ) Notice: Subject to any disclaimer, the term of this patent is extended or adjusted under 35 U.S.C. 154(b) by 0 days.

(21) Appl. No.: 16/652,879

(22) PCT Filed: Sep. 21, 2018

(86) PCT No.: PCT/MX2018/000096
§ 371 (c)(1),
(2) Date: Apr. 1, 2020

(87) PCT Pub. No.: WO2019/070110
PCT Pub. Date: Apr. 11, 2019

(65) Prior Publication Data

US 2020/0248994 A1 Aug. 6, 2020

(30) Foreign Application Priority Data

Oct. 3, 2017 (MX) ..... MX/a/2017/012724

(51) Int. Cl.
*F42B 3/087* (2006.01)

(52) U.S. Cl.
CPC ..... *F42B 3/087* (2013.01)

(58) Field of Classification Search
CPC ..... F42D 1/08; F42B 3/087
(Continued)

(56) References Cited

U.S. PATENT DOCUMENTS 3,122,096 A * 2/1964 Wick ..... F42B 3/28 102/323
3,837,279 A 9/1974 Cooke
(Continued)

FOREIGN PATENT DOCUMENTS

CN 2784865 Y 5/2006
GB 1018089 A 1/1966
(Continued)

OTHER PUBLICATIONS

International Search report for PCT/MX2018/000096, Prepared by the Spanish Office, dated Feb. 19, 2019, 10 pages.

*Primary Examiner* — Bret Hayes
(74) *Attorney, Agent, or Firm* — Brooks Kushman P.C.

(57) ABSTRACT

The present invention refers to an improved invention that is foldable, antistatic with partial compressibility, semi-flexible, thin-walled, with components, which can serve as water insulation, soil stabilizer, continuous extension regardless of the length and even in cases of caverns and/or geological faults, which allows for cushioned blasting by decoupling the hole and which is used in blasting processes in the extraction of minerals, by placing a container in a natural borehole.

The improved invention allows containers as long as required, facilitating transport, providing continuity, the main feature is that it is folded and unfolded, without affecting the shape or functionality of the same when used in drilling and for long containers facilitates transport, storage and handling. In addition, it allows easy loading of the explosive despite the presence of water, cracks, geological faults, previous mining and/or loose ground; it also avoids obstructions or "falls" caused by vibrations during the drilling process or by ground movements caused by nearby blasting, obtaining a clean, continuous, dry and stable borehole, which guarantees maximum advance and
(Continued)

avoids costly rework; allowing the explosive to be dosed using a smaller diameter container and a spacer and anchor ring to form an air chamber between the wall to be protected and to generate a mitigated blast between the wall to be protected, obtaining firm ceilings and/or walls. In addition, in long downward holes, the explosive can remain self-supporting by means of a crossbar or shutter, which protects it from being blocked by transit of people or vehicles; In addition, in long ascending boreholes, they can provide continuity and allow to carry any explosive, stopping it even when loaded for more than 8 weeks, finally eliminating the risk of accumulation of static charges and avoiding the possibility of accidents since these charges can activate the explosives.

10 Claims, 16 Drawing Sheets

(58) Field of Classification Search
USPC ..... 102/324
See application file for complete search history.

(56) References Cited

U.S. PATENT DOCUMENTS

| | | | | | |
|---|---|---|---|---|---|
| 4,000,696 | A * | 1/1977 | Friant | F42B 3/02 | 102/331 |
| 4,369,711 | A * | 1/1983 | Leader | F42B 3/087 | 102/313 |
| 4,787,316 | A * | 11/1988 | Drury | F42B 3/087 | 102/323 |
| 5,259,316 | A | 11/1993 | Nelson et al. | | |
| 5,625,162 | A * | 4/1997 | Appleby | C06C 5/04 | 102/331 |
| 8,028,624 | B2 | 10/2011 | Mattson | | |
| 2002/0050222 | A1 | 5/2002 | Kang | | |
| 2007/0131129 | A1 | 6/2007 | Kang | | |
| 2011/0297030 | A1 * | 12/2011 | Zimmermann | F42D 1/12 | 102/312 |
| 2015/0053106 | A1 | 2/2015 | Godsiff | | |

FOREIGN PATENT DOCUMENTS

| | | | |
|---|---|---|---|
| WO | 03004960 | A1 | 1/2003 |
| WO | 2007004857 | A1 | 1/2007 |
| WO | 2011117337 | A1 | 9/2011 |

* cited by examiner

ANTI-STATIC, FOLDING CONTAINER FOR BLASTING OPERATIONS, WHICH CAN BE PARTIALLY COMPRESSED, AND ASSOCIATED ACCESSORIES

CROSS-REFERENCE TO RELATED APPLICATIONS

This application is the U.S. national phase of PCT Application No. PCT/MX2018/000096 filed on Sep. 21, 2018, which claims priority to MX Patent Application No. MX/a/2017/012724 filed on Oct. 3, 2017, the disclosures of which are incorporated in their entirety by reference herein.

SCOPE OF THE INVENTION

The invention herein is mainly related to the mining and construction industries, in particular to the drilling and blasting phase, it specifically refers to a container to store explosives, with the optional features of being foldable, giving continuity, stabilizing the natural borehole, allowing the dosing of the explosive and decoupling it when it is introduced into it, regardless of the length and diameter, as well as the parts with which it acts synergistically, which allows to improve the performance of the blasting, therefore it is considered a mechanical type invention.

BACKGROUND

This invention is used in areas that require drilling of boreholes where later blasting is performed for the purpose of extracting inert stone material or material with a certain concentration of any mineral. If the consumables (explosives, drill bit steels, energy, etc.), and the work of machinery and manpower can achieve the minimum projected amount of extraction we will obtain a successful blast.

For the performance of blasting, currently (two types of basic explosive mixtures are generally used; the first mixture corresponds to a range of hydrogels or high explosives resistant to water, and the second corresponds to a mixture composed of ammonium nitrate and several types of fuel oils, (conventionally known as ANFO) which are cheaper and are normally used in bulk, however, their limitation is the presence of water as they are water dissolved in it and become useless.

In the case of tunnel boreholes and due to groundwater sources or the tribological action of the materials that make up the drill bits and require water for cooling, water accumulates in works with negative inclination and can flood the lower boreholes, in these cases it is not possible to use ANFO type explosives and is replaced by hydrogels/high explosives either in bulk, generating additional costs in the blasting process.

Other problems in tunnel drilling are the obstruction of the lower holes by the stone waste caused by the formation of the upper holes and also in general in any borehole made in loose or unstable ground, which are obstructed by the vibration of the drilling process, this forces a cleaning reprocessing that is not always successful and subsequently prevent the appropriate loading of explosives.

Both in the case of tunnel boreholes and in the case of so-called "long boreholes" there are geological imperfections (in addition to the presence of water) some of which are: uneven terrain, i.e. rocky and brittle, unstable or loose, caverns, cracks or geological faults natural or caused by previous mining, these prevent a dry, continuous, clean and stable hole—which is necessary for a correct load of explosives—generating explosive waste, energy leakage and preventing a successful blast to cause the minimum amount of projected material, and on the contrary, the overload of explosives in certain areas with the presence of caverns will cause a greater damage than that caused by the expected blast, thus the stability and safety of the area will be compromised, which must be repaired if necessary, causing additional costs.

Another issue arising from certain "long" drilling methods, where reserve boreholes are drilled for future blasting, is that when blasting previous lines, ground movements often obstruct "reserve holes", forcing costly reprocessing.

Another problem in descending "long drilling" is due to the fact that the transit of equipment over prefabricated boreholes causes their obstruction and forces reprocessing.

Additionally, both in tunnels and in certain cases of "long drilling", it is necessary to dose the explosive capacity in the contours to obtain more stable ceilings and walls and to avoid over-breaking, this is solved by using graduated explosives or detached accessories with explosives, which are normally either expensive and/or not suitable.

Another problem in long upward drilling is that the action of gravity acts on the ANFO explosive in dry soils and it spills, having to be charged with high explosive and additional cost, in case of caverns or cracks there will be energy leakage and waste of any explosives used, in addition to requiring reserve boreholes in highly fragmented and explosively laden terrain, and due to previous blasting they are at risk of being partially or totally discharged and will have to be thoroughly washed in order to be re-drilled and reloaded, which significantly increases the time spent and costs.

In order to obtain the expected result, the use of specific containers suitable for each particular case is required, i.e. custom designed (diameter and length) for the operation and suitable for contact with explosives. The current containers do not always meet these requirements and with the necessary strength and flexibility for handling, transport and rough handling; which implies process delays, increased machine and man-hours caused by rework, wastage of explosives, and as a consequence extra costs for the operation and low productivity; some accessories used that are not antistatic are also not suitable to be charged with explosives, since there is accumulation of static charges and potential risk of early explosions, which can cause damage to property, installations and people, increasing the risk of the operation.

Traditionally, existing containers are made of plastic materials; however, the following inventions are state of the art; particularly because my previous invention has been modified, that is why I present it initially as the closest of the proposed inventions.

My invention WO2007004004857 A1, which refers to a synthetic borehole aimed for construction and underground mining, which is composed of a semi-rigid plastic tube that facilitates the filling of a bulk explosive; this tube keeps the explosive dry and retains it in accordance with the structure of the borehole; in addition to holding it, it is important to mention that it protects it from the structure and the vibrations produced during the pounding that takes place in the ground In the body of the invention, it specifically refers to a set of improvements of those made to the holes that are used in the underground mining industry and in construction its main focus is for the extraction of minerals and earthmoving works and it is a mainly a matter of an internal coating and/or extension of the boreholes made (holes) in which the explosive will be loaded to make the ground explode the plastic pipe is composed of a thin wall, is cylindrical, straight, semi-rigid, antistatic and characterized by an elongated cylindrical tube, open at one end by which the explosive is loaded and sealed to prevent water from entering from the other end.

My invention has been improved, given that it was initially made of a semi-flexible material, there was no proposal to make it foldable for transportation and on the other hand, that at the time of unfolding it can return to its original shape allowing the explosive material to reach the most distal end of that from where it is introduced; The different tips also allow the use in different types of soil and give the ability to self-support and/or occlude in long downward boreholes. They also allow the retention of the explosive in long upward holes and the disconnection and dosing of the explosive in both contour boreholes in tunnels and at the wall of long boreholes. Although this is the improved invention, other inventions that do not exceed or are not related to this technical characteristic of my invention are already in the state of the art.

Another similar invention is US2015053106 A1 which consists in a cartridge that is provided with a receptacle with a propellant and an open end with a towing device secured to the open end to form a substantially closed container. The stem device is operable to accommodate radial expansion and has a static component secured to the receptacle and a movable piston, at least partially inside the vessel, relative to the static component and the receptacle. The cartridge is configured in such a way that the ignition of the propeller causes the movement of the piston to actuate the towing device and cause its radial expansion before the receptacle brakes.

Among its variants, it has bushings, pistons, wires that cross it longitudinally and is activated by buttons, which cause radial explosions through the slots circumferentially spaced with anchoring elements.

The invention U.S. Pat. No. 8,028,624B2 consists of a cartridge for drilling holes with an elongated tube that the first end has an opening with a detonator and the second end that closes it and where a connector is located to release a second adjacent cartridge that has the essentially cylindrical shape that is inserted into a monolith firstly in an axial manner with a flange and which is fitted with a handle; and finally a firing pin is actuated as it forms a collar which receives a connection from a detonator. Among its variants the collar is at least 10% of the cartridge wall; the detonator is button-sensitive; the cartridge is made of synthetic polymer; the firing pin consists of a bulge surrounded by an angular region; this angular region is preferably 10% of any wall of the cartridge.

The invention CN2784865 Y consists of a utility model providing a plain tube, comprising a non-sparking body. The utility model is characterized by the fact that the side walls of the pipe body are symmetrical along the longitudinal direction and are concave inwards to form two elongated energy storage channels; the pipe body cavity is divided into two cavities by a spacer plate across the longitudinal direction; the two energy accumulators are arranged on the same side of the spacer plate and the cavity it contains and the energy storage channels are filled with an explosive. When used, the tube cavity protects the surrounding rocks to break them under pressure.

Finally the invention GB1018089A which consists of a casing that is manufactured by compressing and synthesizing a metallic powder, which is exposed to a thermochemical treatment that causes the diffusion of gases; the casing is manufactured to contain an explosive charge, comprising powdered iron compressed at 500° C. reduced in a hydrogen atmosphere at 1040° C. and hardened in a carbon monoxide atmosphere at 900° C.; with some variants involving oxidation to a depth at 500° C. or impregnation with 26% copper during hydrogen treatment.

DESCRIPTION

The characteristic details of this innovative folding blasting container, antistatic and capable of being partially compressed, are clearly shown in the following description and in the enclosed figures, as well as a description of those areas where the same reference signs are followed to indicate the parts and figures shown.

BRIEF DESCRIPTION

The examples of the presented alternatives are merely illustrative but not exhaustive.

Based on the above figures, the foldable container with the capacity to be partially compressed with its accessories and antistatic for blasting is introduced into a natural borehole N produced by conventional drilling machinery as a cover for it, due to its characteristic of being semi-flexible and partially compressible it prevents that the imperfections probably existing in some grounds, to accentuate or to arise with drilling, in some cases it may even require the container to have a tip to guide its penetration into the natural hole N.

Figure 1:
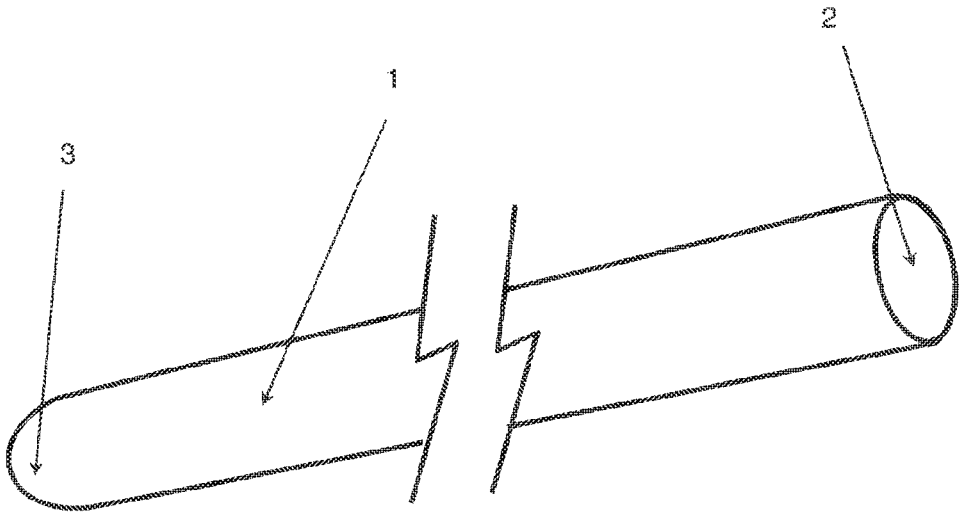
FIG. 1 is a conventional perspective view of the foldable, antistatic blasting container with the ability to be partially compressed with its components.
Figure 2:
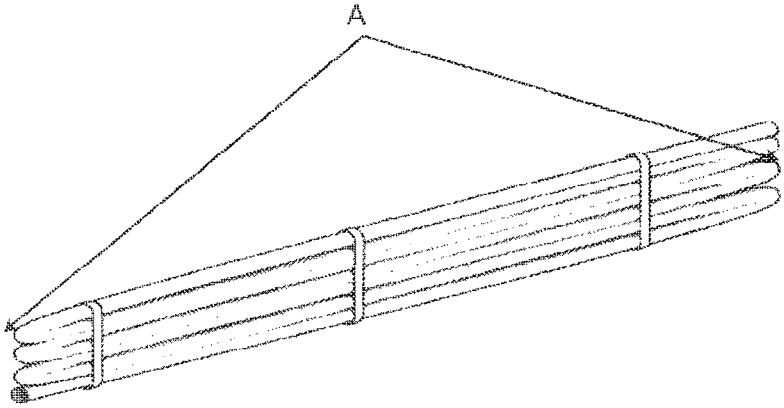
FIG. 2 is a perspective view that shows the foldable, antistatic blasting container, with the capacity to be partially compressed, folded, which makes it easy to move and handle in transport and in mine tunnels when it is very long, just to illustrate two places where and how it is used.
Figure 3:
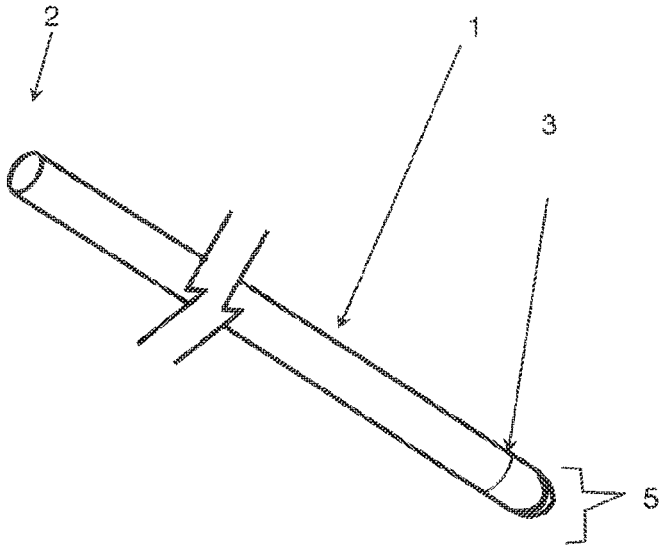
FIG. 3 is a conventional perspective view rotated (with respect to the first figure) of the foldable antistatic blasting container, with ability to be partially compressed with its components, sectioned whose tip is screwdriver shaped.
Figure 6:
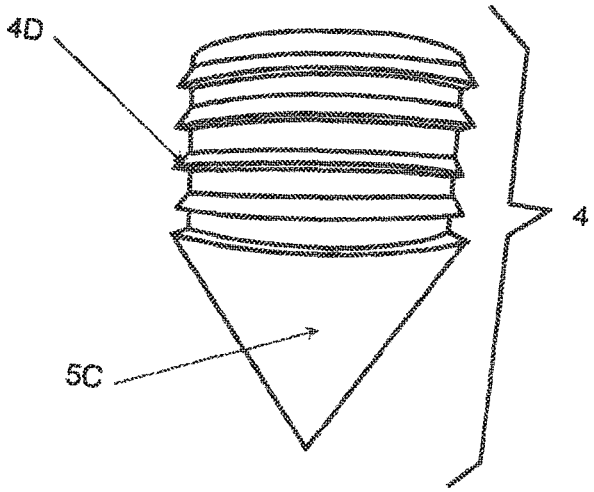
FIG. 6 is a conventional perspective view of the connector engaged in the tip (in this example it is used with the conical tip).
Figure 9:
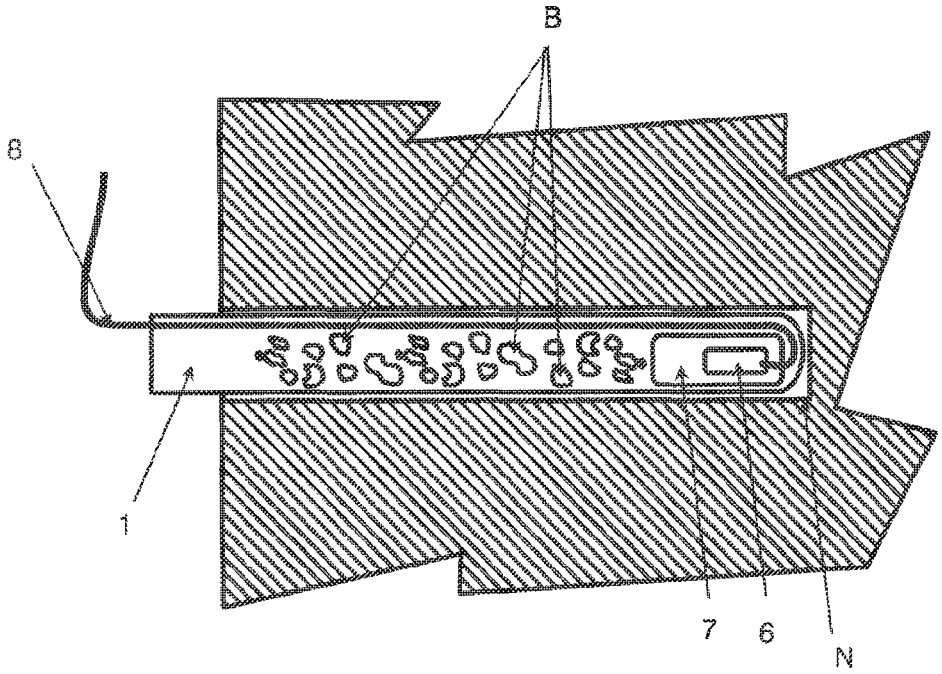
FIG. 9 is a cross-sectional view of the elements that make up the foldable antistatic blasting container with the ability to partially compress with its components, being used in a section of the blasting area, for use horizontally or slightly inclined.

The foldable container (FIG. 1) with the capacity to be partially compressed with its components and antistatic for blasting consists of a tube 1 preferably open at one end 2 through which the explosive is introduced and at the other end 3 is closed, this tube 1 is made of semi-flexible antistatic material, which allows it to fold up for transport and facilitate handling to the place of use, once it is unfolded there and recovers its original shape, this property allows it to have any diameter and length required, without losing its features since the deformation suffered in the A folds (see FIG. 2) is reversed when unfolded; it contains a tip 5C (FIG. 6) that is placed using a 4 connector, for which it has at least one notch 4D that allows it to be pressed into one end of tube 1, thermally or by other means, and due to its property of being partially compressed, it can be inserted more easily in case of obstructions; inside tube 1 (FIG. 9), a detonator 6 (which can be wireless) is placed inside tube 1 that is attached to a cartridge 7 the detonator 6 is attached to a starter wire 8 which extends to the outlet of the natural borehole N and explosive material B is placed along the internal part of tube 1; when the firing charge is activated using starter wire 8 activates detonator 6 or is activated wirelessly, then the explosion is produced.

Figure 23:
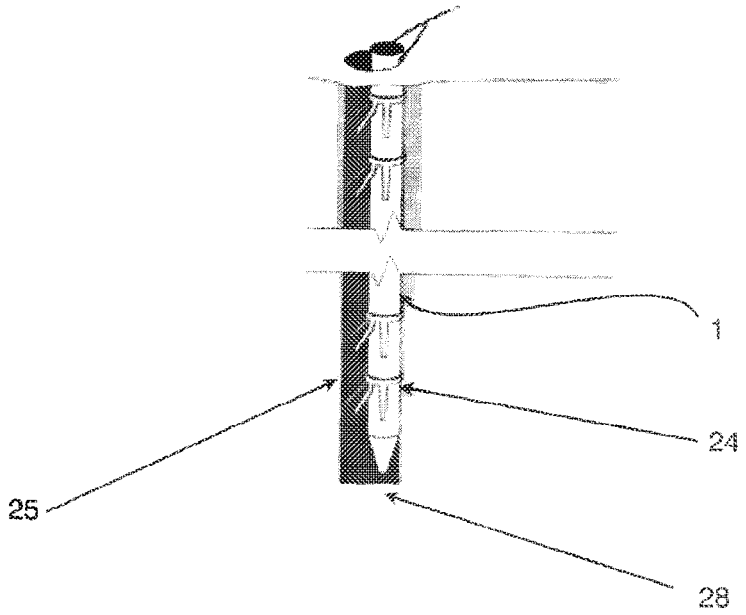
FIG. 23 is a view of the foldable, antistatic blasting container capable of being partially compressed with its components and used in a natural borehole decoupled by the spacer ring and anchor attachment.
Figure 24:
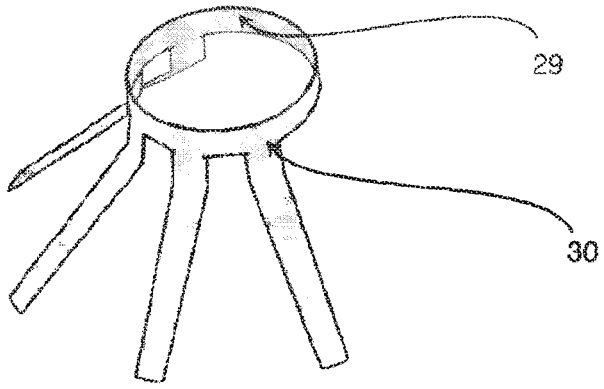
FIG. 24 is a conventional perspective view of the spacer ring and anchor attachment.

The foldable container with the capacity to be partially compressed with its components and antistatic for blasting used in contours is preferably smaller in diameter and length than the natural hole N (FIG. 9,) except in vertical holes, this will dose the explosive in smaller quantities and in the case of horizontal holes and if there is water in the horizontal holes ANFO can be used using plug 18 to isolate it; and to contain the energy is placed the plug 19 in a range between five to thirty centimeters from the mouth of the natural hole N, this plug 19 will form in conjunction with the invention a conventional air chamber 25 that will cushion the effects of blasting, this chamber will be formed in the roof or upper holes (26) by gravity, and on the roofs, boards or sides (27) with a spacer ring and anchor (24); in downward vertical holes (see FIG. 23) will be smaller in diameter and will be separated from the wall to be protected by means of several anchor spacing rings forming an air chamber that will cushion the effects of blasting, if necessary to retain the initiator and confine the explosive will have a reduction in diameter at the end of the bottom 28.

All variants that the connector may have (see FIG. 6), can count instead of 4D notches with threads, seals, etc. or any combination of these. Some of the variants are described below.

Figure 7:
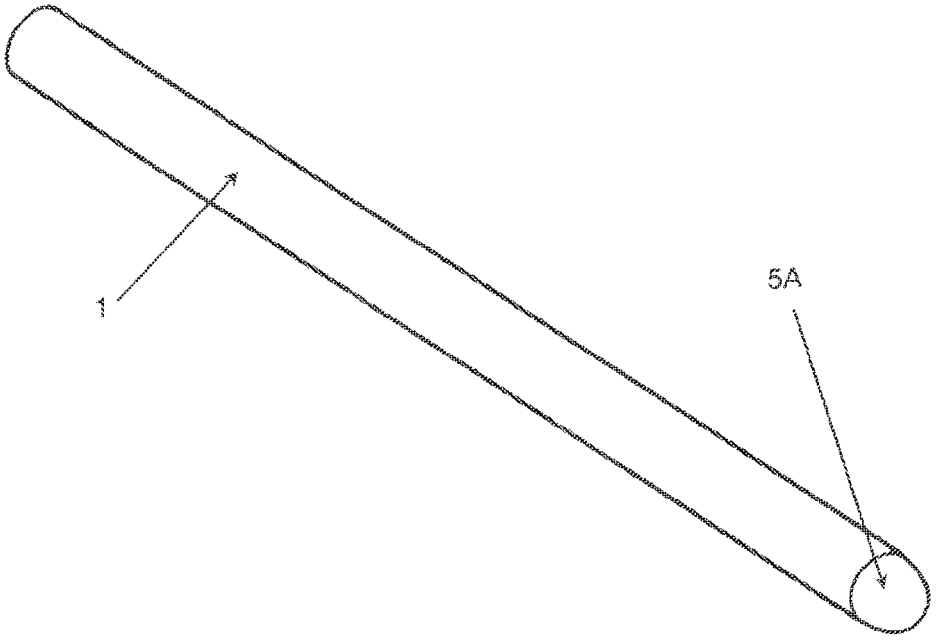
FIG. 7 is a conventional perspective view of the foldable antistatic blasting container, with the ability to be partially compressed with its components, which tip has an oval shape.

A first variant of the foldable container described above used in horizontal holes is that the tip that is attached to tube 1 has a oval-shaped protrusion 5A (see FIG. 7), which is used preferably in rigid grounds that conventionally have no edges and the tip with this shape allows the invention to slide to the desired point to perform the explosion; this variant can be used, with or without the presence of water inside the hole; it is important to emphasize that its property of being partially compressed will allow to overcome small obstructions.

Figure 4:
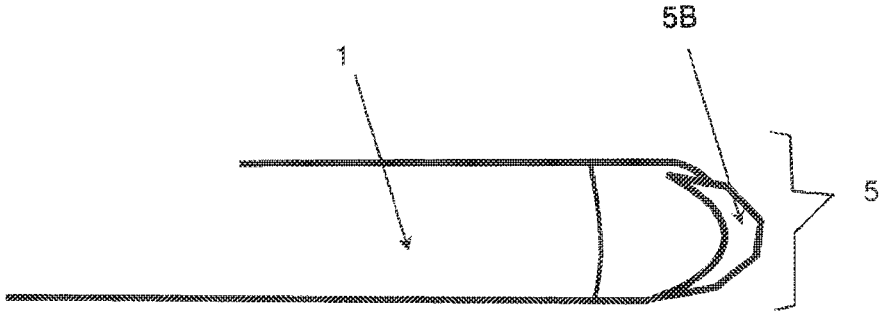
FIG. 4 is a conventional perspective view of the foldable antistatic blasting container, with the ability to be partially compressed with its components, the tip of which is screwdriver shaped.
Figure 8:
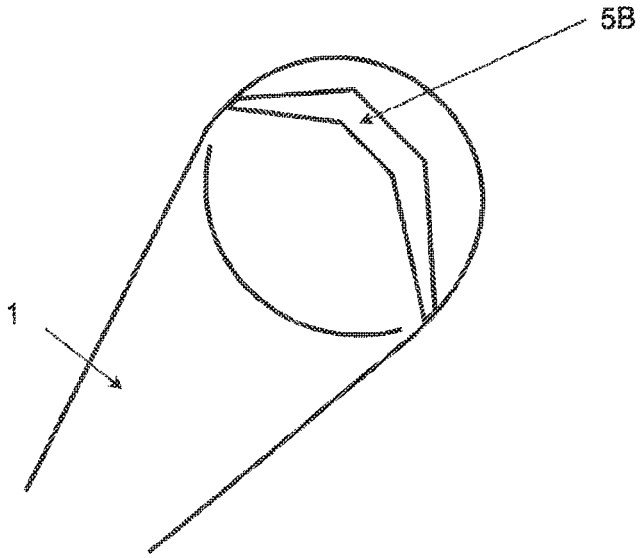
FIG. 8 is a conventional top perspective view of the foldable antistatic blasting container, with the ability to be partially compressed with its components, sectioned and approached at its screwdriver-shaped tip.

A second alternative of the foldable container described above used in horizontal boreholes is that one end of tube 1 is thermally fused into the shape of a screwdriver tip 5B (see FIGS. 4 and 8), this serves to remove the materials that are released upon its introduction into the natural borehole N, as a final result we can form a clean, dry, continuous and stable borehole, which can be loaded with any explosive, even if it is flooded with water.

Figure 5:
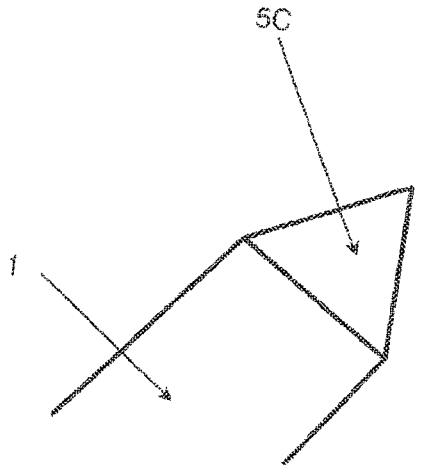
FIG. 5 is a side view of the foldable blasting container with its components, antistatic with the ability to partially compress, whose tip has a conical shape which allows it to be partially compressed to be introduced more easily in case of partial obstructions.

A third alternative of the foldable container described above is that the tip 5 has a conical protrusion 5C (see FIG. 5), which allows it to slide on its sides the materials that are released when making the natural borehole N where it is inserted also gives it a hermetic seal and which allows it to be inserted partially when the container is compressed, despite the fact that there are some excess materials that are released when making the natural hole N where it is inserted, it also gives it a hermetic seal and allows it to be inserted even more easily into holes of great length.

Figure 10:
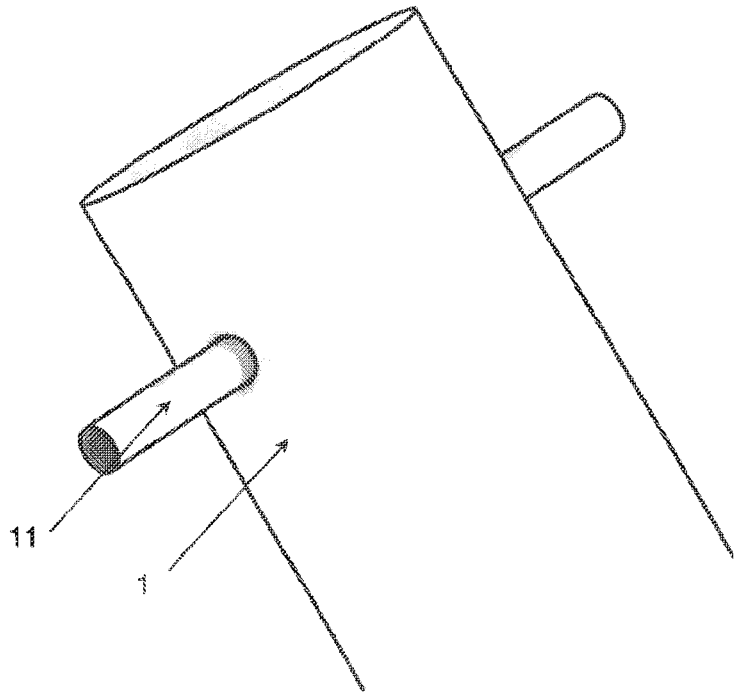
FIG. 10 is a conventional perspective view of the fastener cross member used in long descending drilling at the upper end of the foldable antistatic container with the ability to partially compress with its components.
Figure 11:
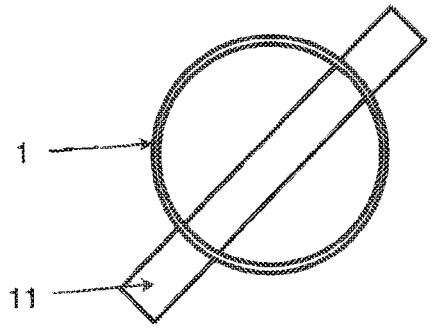
FIG. 11 is an axial end view of the upper end of the foldable antistatic container shown in FIG. 10.

A fourth variant of the foldable container described above is one that can be provided with any of the tips described above and used in downward holes that do not have a supporting floor and are to be loaded, for which purpose a crosshead 11 (FIG. 10) is placed at the entrance that serves as a support for the loaded container.

Figure 12:
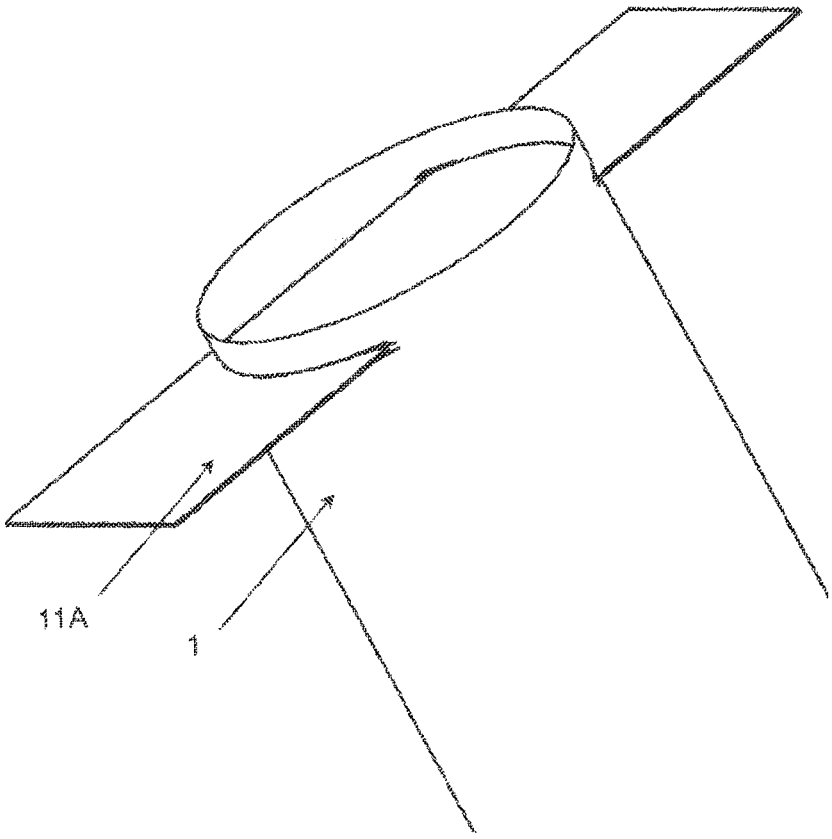
FIG. 12 is a conventional perspective view of an alternative sheet fastener cross member used in long descending drilling at the upper end of the foldable antistatic container with the ability to partially compress with its components.
Figure 13:
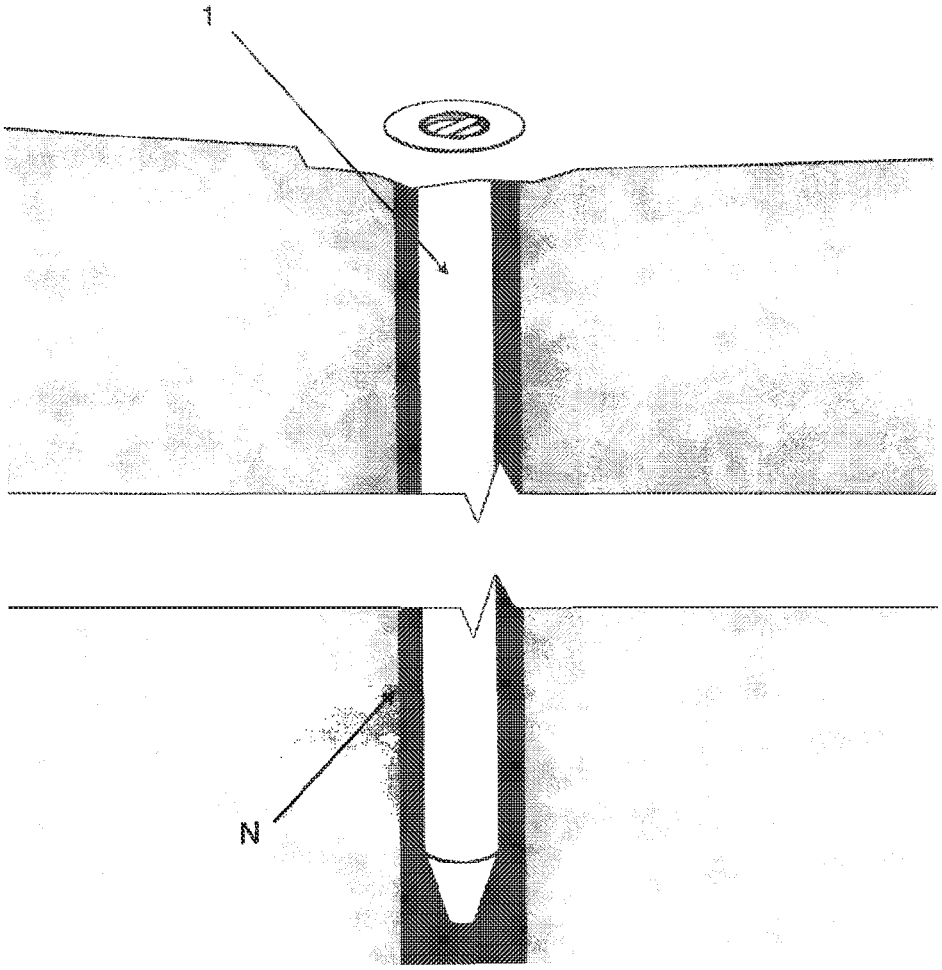
FIG. 13 is a conventional perspective view, sectioned and in detail of the cap type "hat" that is used in descending long drilling and placed on one end of the foldable antistatic container with the ability to partially compress with its components in one of the variants, which functions as fixer-obturator in the entrance of the same and which avoids being obstructed with material of the traffic of the vehicles, this plug self-supports the invention.
Figure 14:
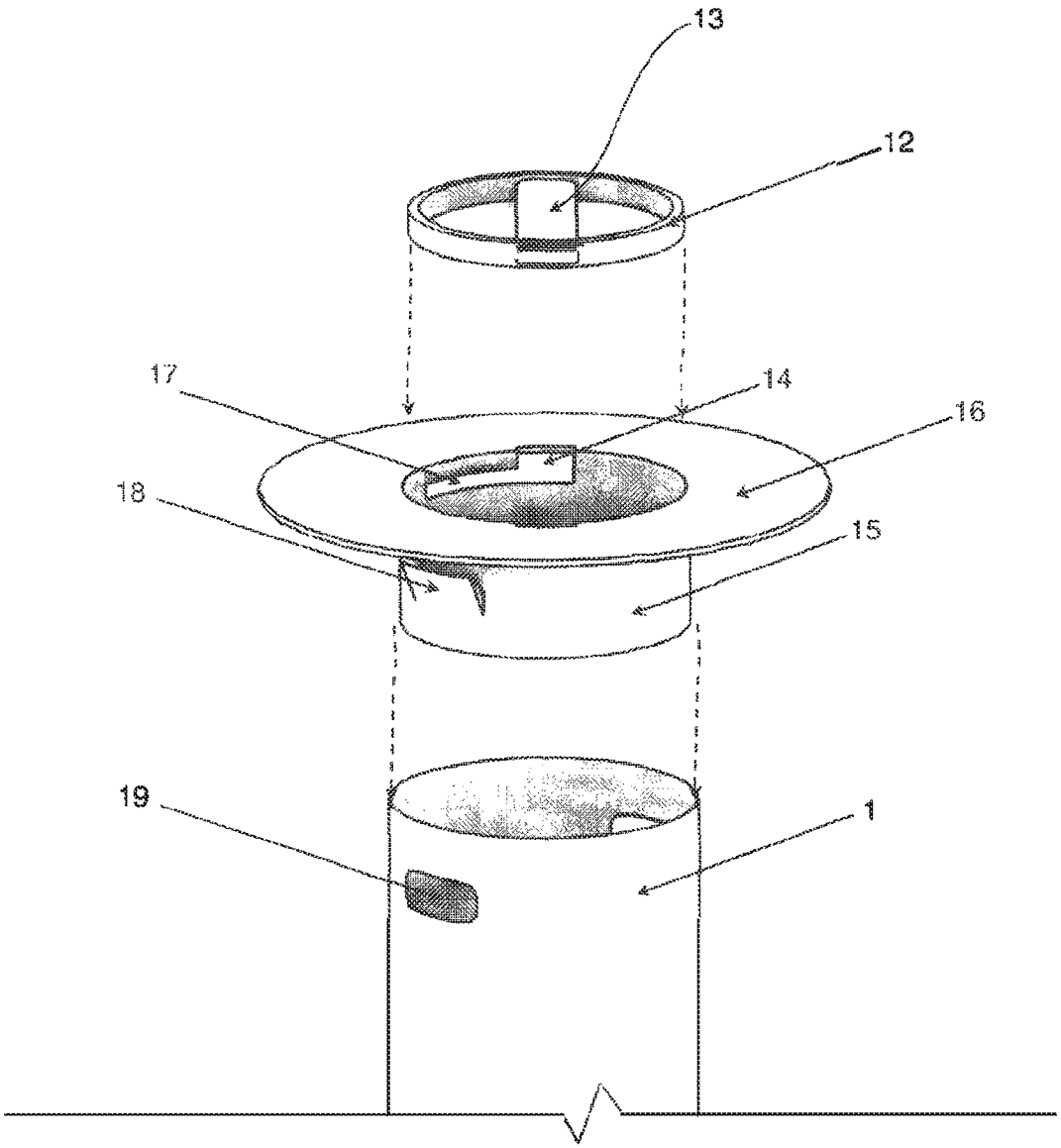
FIG. 14 is an exploded view of the detailed components of the "hat" type cap that is used in long downward drilling and placed on one end of the foldable antistatic container with the ability to be partially compressed with its components in one of the variants.
Figure 15:
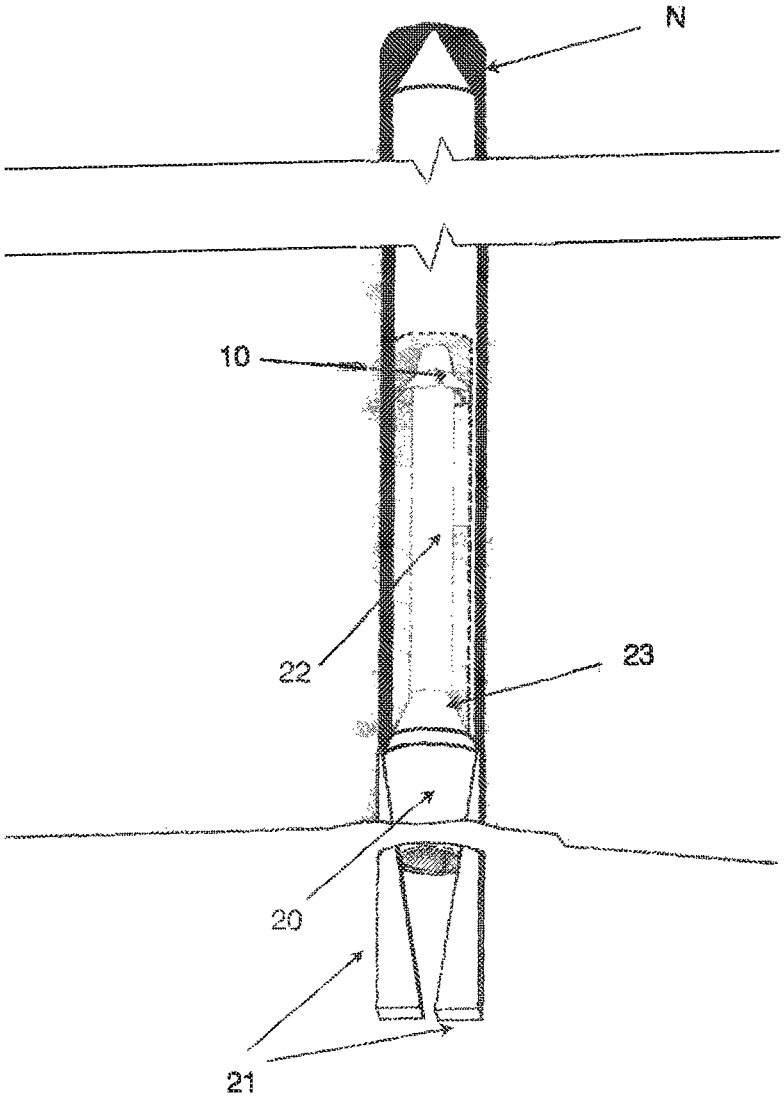
FIG. 15 is a sectional and detailed lateral view of the anchorage and support system for long upward drilling of the foldable antistatic container with the capacity to be partially compressed with its components in one of the variants, which acts as a fixator—shutter at the entrance of the container and prevents it from falling due to the attraction of gravity, even when loaded with explosives. This system supports the invention.
Figure 16:
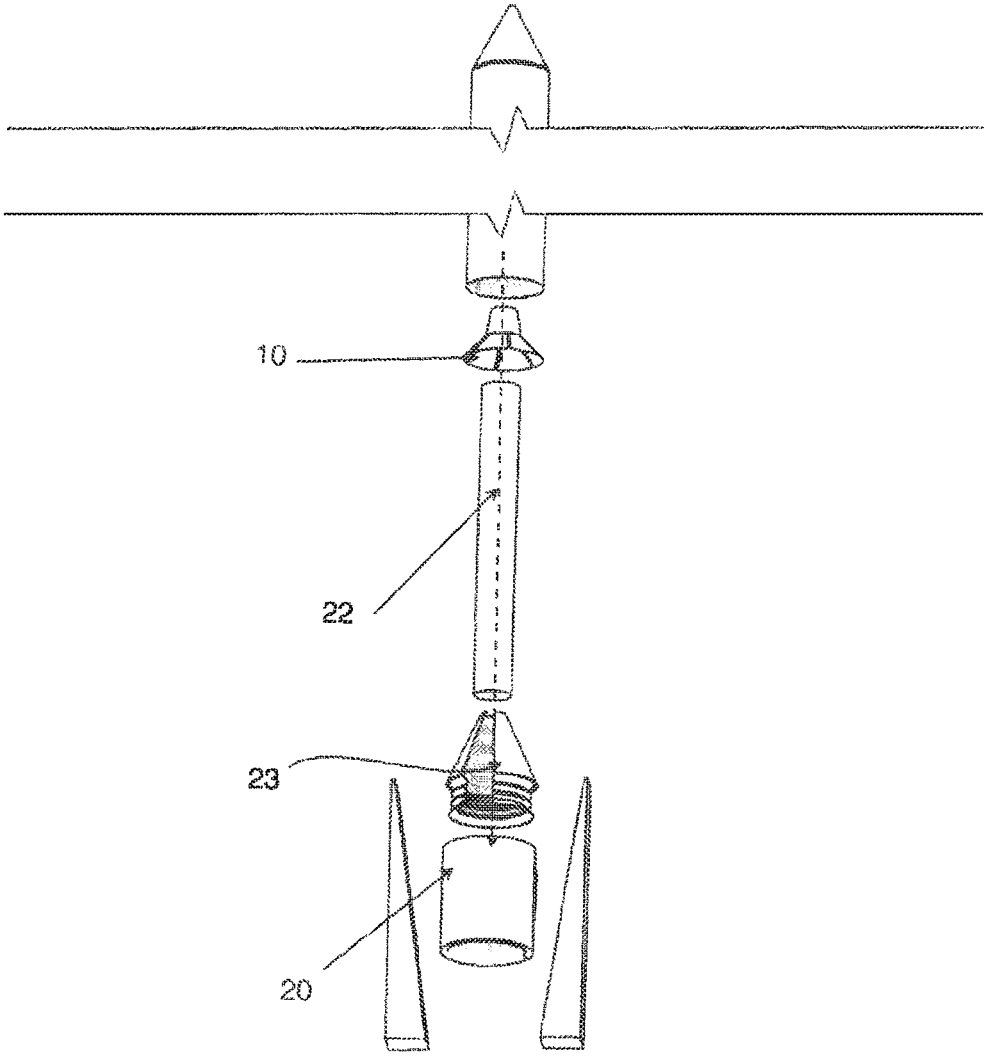
FIG. 16 is an exploded view of the anchorage and support system for long upward spiral drills of the foldable antistatic container with the capacity to be partially compressed with its components in one of the variants.
Figure 17:
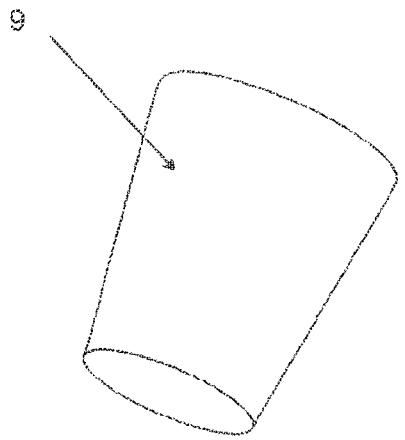
FIG. 17 is a conventional perspective view of the insulator cap of the foldable, antistatic blasting container hat can be partially compressed with its components.
Figure 18:
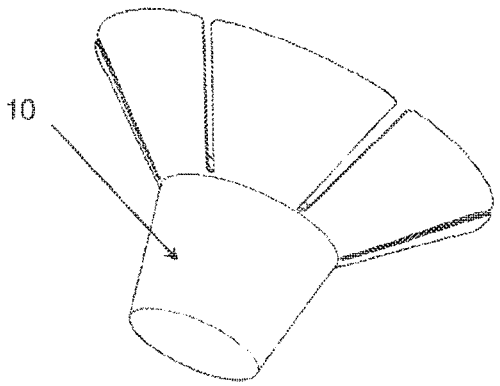
FIG. 18 is a conventional perspective view of the underground power plug of the foldable, antistatic, blasting container capable of being partially compressed with its components.
Figure 19:
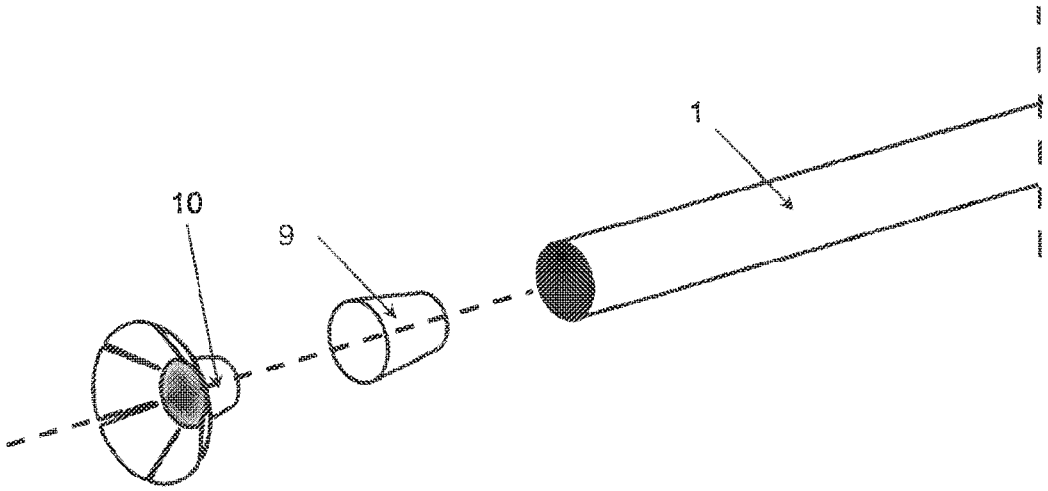
FIG. 19 is a conventional perspective view of the components of the foldable, antistatic blasting container with the ability to be partially compressed with its components, viewed from the opposite end from the one housing the tip.
Figure 20:
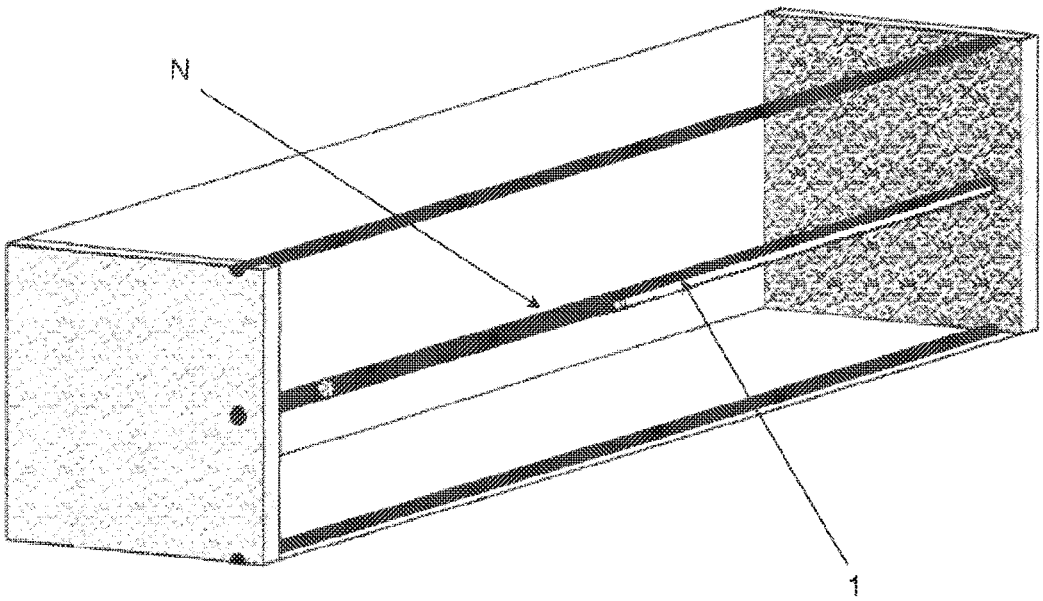
FIG. 20 is a conventional perspective view of the foldable, antistatic blasting container capable of being partially compressed with its components, used in a decoupled natural borehole, where the soil has been prismatically sectioned to understand its use.
Figure 21:
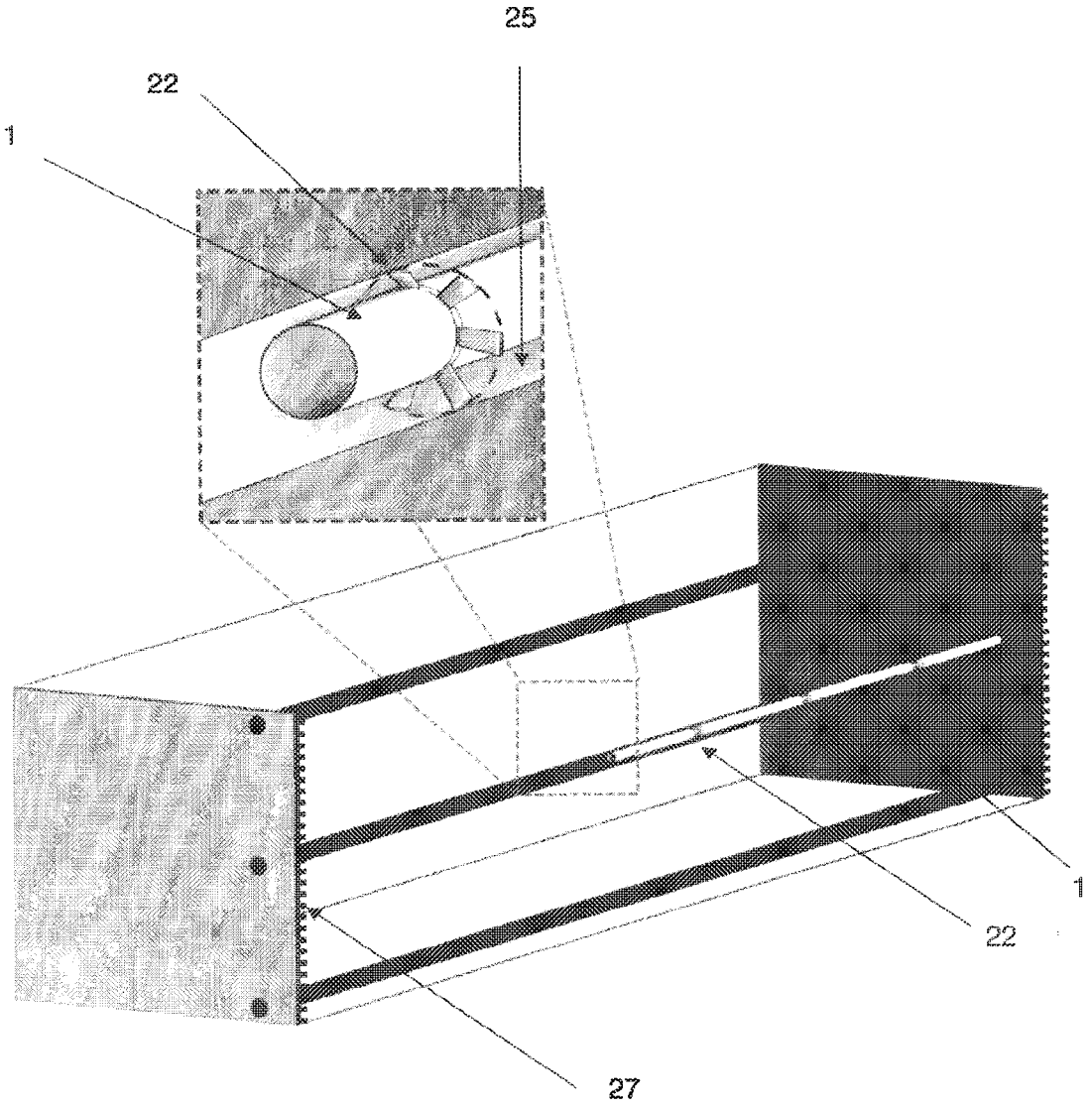
FIG. 21 is a conventional perspective view of the foldable, antistatic blasting container capable of being partially compressed with its components, used in a natural horizontal borehole in the board area, forming an air chamber by means of the spacer ring and anchor fitting.
Figure 22:
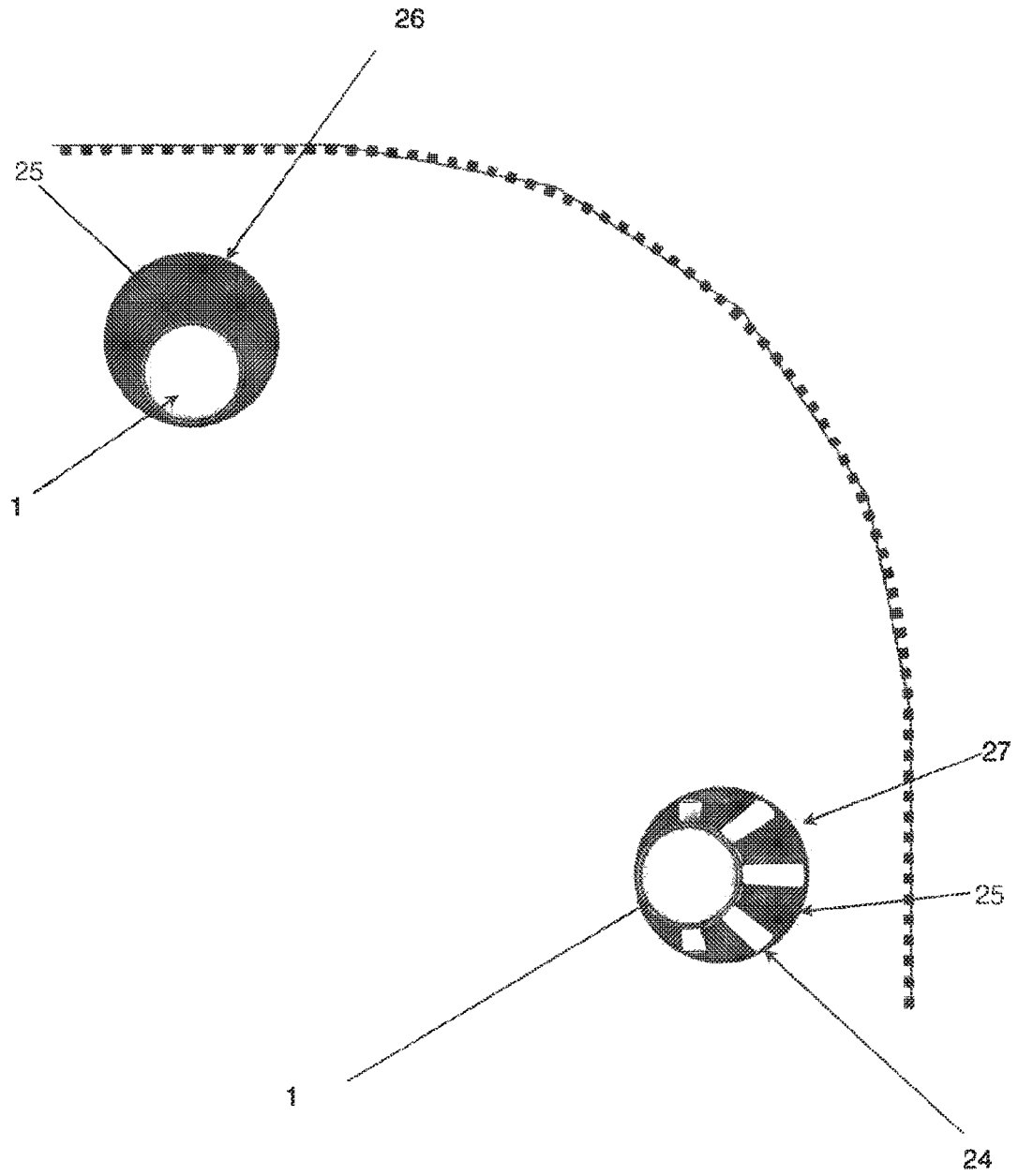
FIG. 22 is a front view of the foldable antistatic blasting container, with the capacity to be partially compressed with its components, being used in the boreholes of the roof and board contour, the latter decoupled by means of the separating ring and anchor accessory, showing the air chambers formed in both, the one of the roof formed by the action of gravity.

A fifth variant of the foldable container described above is the one that can have any of the tips described above and be used in downward holes that do not have a support floor and are left as reserve holes, for which they require a fixator-blocker at the entrance of the same to prevent it from being obstructed with material from vehicle traffic, consisting of a sheet 11A (FIG. 12), which self-supports and/or seals it, which at the time of loading is removed and can be replaced by a crosshead 11.

A sixth variant of the foldable container described above consists in having any of the tips described above and be used in long downward holes that do not have a support floor and are left as reserve holes, for which they require a fixator-shutter at the entrance of the same to prevent it from being obstructed with material from vehicle traffic, composed of a first ring 16 which self-supports tube 1 because it has a larger diameter upper part than the natural hole and is joined to it with at least a notch 18 by inserting the lower part 15 and fixing it by means of a hole 19 forming a single piece, a second ring 12 which serves as a cover to avoid obstructing the natural borehole, fitting onto the first ring by means of a protrusion 13, which enters at least one hole 14 and is removed at the moment of loading with a simple turn.

A seventh alternative of the folding container described above is the one that can have any of the tips described above and be used in upward holes, requires a fixator-shutter at the entrance of the container to prevent it from falling the container and the explosive by the action of gravity, once inserted tube 1 will be placed a ring 20 which is held by 2 stakes 21, charged with explosive and placed the Underground Energy Plug 10, which goes on top of a tube 22 that must have the length required by the air chamber M, this will rest on the shutter 23 with a trimmed conical shape, which has the function of retaining the explosive and allows the blasting starter wire to pass through it, this shutter has in one of its parts a threaded structure which passes through the ring 20, thus the container and the explosive are confined to the bottom without gravity affecting them.

An eighth alternative of the foldable container described above is the one that can have any of the tips described above, characterized by the fact that it has a significantly smaller diameter than the natural borehole remaining separated from the wall to be protected by means of several spacer rings and anchors 24 forming an air chamber 25 that allows for a mitigated blast (FIG. 23), if required, one of its ends will be partially reduced to stop the initiator and confine the explosive.

The present invention preferably has a wall thickness between 1 mm to 8 mm and a diameter preferably between ½ inch to 14 inches, as well as a length preferably between 0.5 meters to 50 meters, which allows the device to adapt to any type of borehole in a mine.

FUNCTIONING OF THE INVENTION

Having the information of the type of borehole and the geology, the type of container will be defined and if it requires any of the components, when introduced and regardless of the length of the same thanks to its property of being foldable, it will serve as a stabilizer of the same preventing the collapse or the blockage from occurring by the vibration or the rock fall in unstable grounds, as well as by the earth movements of previous blasting and/or traffic of vehicles above them; It will also give continuity to the hole even though there are caverns and/or geological faults, by the possibility of using diameters and lengths as required in a single piece, will allow dosing the amount of explosive that will allow a cushioned blast; Its antistatic property prevents the accumulation of electrical charges, when it has a tip on one of its ends, it is hermetic and waterproof and it is possible to charge it with any explosive in areas with the presence of water; it does not require the coupling of pipes or the assembly of sections, since due to its property of being partially compressed it can be bent transversally, transported, introduced into the natural hole and form a single body along the hole regardless of its length; it is important to emphasize that due to its property of being partially compressed it will allow small obstructions to be avoided.

Having sufficiently described my invention, what I consider to be a novelty and therefore claim my exclusive property is contained in the following claims:

1. A tubular container for explosive devices and/or explosive materials, and/or explosive initiators comprising:

a foldable elongate plastic, antistatic and semi-flexible tubular body, having an open end, a longitudinal length defining a longitudinal axis, and a closed end; and a tip configuration comprising a tip insert that is hermetically sealed to the closed end of the tubular body configuration that seals the closed end and facilitates the insertion of the tubular body into a natural borehole;

wherein the longitudinal length of the tubular body is sufficient to allow the open end to extend out of the borehole to receive an explosive device and/or explosive materials and/or explosive initiators, therein.

2. The container of claim 1, wherein the tip insert has least one notch that allows it to be pressed into the closed end of the tubular body.

3. The container according to claim 1, further comprising a crossbar located perpendicular to the longitudinal axis of the tubular body, towards the open end.

4. The container of claim 3, wherein the crossbar crosses transversely the open end of the tubular body, whereby two side perforations diametrically opposed to each other are provided towards the open end, to allow the positioning of the crossbar.

5. The container according to claim 1, further comprising a fixing-shutting element inserted perpendicular to the longitudinal axis of the tubular body, towards the open end, to temporarily cover the open end of the tubular body.

6. The container of claim 5, wherein the fixing-shutting element is a plate, which shape and dimensions must be sufficient to support the container and its contents, and to shut the open end, whereby two side slots diametrically opposite each other are provided towards the open end, to allow the placement of the plate.

7. The container of claim 5, wherein the fixing-shutting element consists of:

i) an annular piece which is inserted into the open end, wherein the upper perimeter edge of the annular piece projects into a perpendicular portion which dimension is sufficient to cover and support itself over the edge of the natural bore, said annular piece further comprising at least one external notch, and at least one perforation, which extends into a slot; whereby at least one lateral perforation is provided in the open end of the tubular body for the notch to be inserted therein; and ii) a cover closes the entrance of the annular part, which in turn comprises a fixing element, which is inserted into the perforation of the annular part to fix the cover to the annular part; and the slot allows the fastening element to slide when inserted into or removed from the perforation.

8. The container according to claim 5, wherein the fixer shutter comprises:

i) a conical and hollow piece, which is press-fitted into the inlet of the open end of the tubular body, wherein said conical piece has a base with external thread for screwing with the internal thread of a;

ii) a ring that will hold the container with its contents; and iii) stakes which in turn will support the ring.

9. A tubular container for explosive devices and/or explosive materials, and/or explosive initiators comprising:

a foldable elongate plastic, antistatic and semi-flexible tubular body, having an open end, a longitudinal length defining a longitudinal axis, and a closed end;

the closed end having a tip configuration that seals the closed end, wherein the tip configuration comprises: an oval protrusion, or a protrusion having the shape of a slot-head screwdriver tip, both formed by a heat-fusing edges of the closed end of the tubular body and facilitates the insertion of the tubular body into a natural borehole;

wherein the longitudinal length of the tubular body is sufficient to allow the open end to extend out of the borehole to receive an explosive device and/or explosive materials and/or explosive initiators, therein.

10. The container according to claim 9, further comprising a fixing-shutting element inserted perpendicular to the longitudinal axis of the tubular body, towards the open end, to temporarily cover the open end of the tubular body.

* * * * *